US006666390B2

(12) United States Patent
Itou

(10) Patent No.: US 6,666,390 B2
(45) Date of Patent: Dec. 23, 2003

(54) SEALING SURFACE PRESSURE INCREASING ARRANGEMENT OF FLUID CONDUCTING SYSTEM

(75) Inventor: Takehiro Itou, Chita-gun (JP)

(73) Assignee: Denso Corporation, Kariya (JP)

( * ) Notice: Subject to any disclaimer, the term of this patent is extended or adjusted under 35 U.S.C. 154(b) by 106 days.

(21) Appl. No.: 10/074,216

(22) Filed: Feb. 14, 2002

(65) Prior Publication Data

US 2002/0109022 A1 Aug. 15, 2002

(30) Foreign Application Priority Data

Feb. 14, 2001 (JP) ..... 2001-036474

(51) Int. Cl.[7] ..... B05B 1/00; F02M 39/00

(52) U.S. Cl. ..... 239/600; 239/533.3; 239/533.8; 239/533.9; 239/533.11

(58) Field of Search ..... 239/88, 96, 533.3, 239/533.8, 533.11, 600; 251/367

(56) References Cited

U.S. PATENT DOCUMENTS 3,406,912 A * 10/1968 Claffey ..... 239/533.3
5,472,142 A 12/1995 Iwanaga
5,553,781 A * 9/1996 Barkhimer et al. ..... 239/88
5,718,386 A * 2/1998 Haug ..... 239/600
6,269,795 B1 * 8/2001 Ripper et al. ..... 239/533.9

* cited by examiner

*Primary Examiner*—Steven J. Ganey
(74) *Attorney, Agent, or Firm*—Nixon & Vanderhye P.C.

(57) ABSTRACT

Reduced thickness portions in a form of a recess are formed in a contact surface in a lower end of a tip packing, which contacts with an upper end of a nozzle body. Furthermore, reduced thickness portions in a form of a recess are formed in a contact surface in an upper end of the tip packing, which contacts with a nozzle holder. With this arrangement, a sealing surface pressure around a connection between corresponding fuel passages is increased with use of a reduced axial fastening force by reducing the sealing surface area in each contact surface. Furthermore, one of the reduced thickness portions formed in the contact surface in the upper end of the tip packing is used as a leakage recovery passage.

8 Claims, 4 Drawing Sheets

SEALING SURFACE PRESSURE INCREASING ARRANGEMENT OF FLUID CONDUCTING SYSTEM

CROSS REFERENCE TO RELATED APPLICATION

This application is based on and incorporates herein by reference Japanese Patent Application No. 2001-36474 filed on Feb. 14, 2001.

BACKGROUND OF THE INVENTION

1. Field of the Invention

The present invention relates to a sealing surface pressure increasing arrangement of a fluid conducting system, which is capable of increasing a sealing surface pressure around a connection between fluid passages in the fluid conducting system. More particularly, the present invention relates to a sealing surface pressure increasing arrangement of a fuel injection nozzle of an internal combustion engine.

2. Description of Related Art

The present invention relates to a sealing surface pressure increasing arrangement of a fluid conducting system, which is capable of increasing a sealing surface pressure around a connection between fluid passages in the fluid conducting system. More particularly, the present invention relates to a sealing surface pressure increasing arrangement of a fuel injection nozzle of an internal combustion engine.

One previously proposed fuel injection nozzle 100 of an internal combustion engine is provided in each cylinder of the internal combustion engine. With reference to FIGS. 3 to 4C, the fuel injection nozzle 100 has a retaining nut 104. The retaining nut 104 makes tight sealing contact of a contact surface between a nozzle body 101 and a tip packing 103 and also makes tight sealing contact of a contact surface between the tip packing 103 and a nozzle holder 102 by applying a predetermined axial fastening force to these contact surfaces. In the fuel injection nozzle 100, there is no particular structure for achieving the tight contact in these contact surfaces, and the tight sealing contact is achieved only by applying the predetermined axial fastening force to the contact surfaces from the retaining nut 104.

The tip packing 103 includes pin holes 111, 112 and a fuel relay passage 108. The pin holes 111, 112 receive corresponding positioning pins for positioning between the nozzle body 101 and the nozzle holder 102. The fuel relay passage 108 communicates a pressure chamber 105 and a fuel feed passage 106 of the nozzle body 101 to a fuel supply passage 107 of the nozzle holder 102.

The nozzle holder 102 has a leakage recovery passage 109. The leakage recovery passage 109 recovers fuel leaked through the contact surface of the nozzle holder 102 and through the contact surface of the tip packing 103 and conducts the leaked fuel to a low-pressure pipeline system. One end of the leakage recovery passage 109, which is located adjacent to the contact surface of the nozzle holder 102, is communicated with another leakage recovery passage 110. This leakage recovery passage 110 communicates an axial bore 115 of the tip packing 103 and an axial bore 116 of the nozzle holder 102 to the leakage recovery passage 109.

In recent years, fuel injection pressure of a fuel injection nozzle of a diesel engine has been progressively increased. Thus, there is a demand for increasing a sealing surface pressure between the contact surfaces of the components by increasing the axial fastening force of the retaining nut. However, when the contact surface of the nozzle body and the contact surface of the nozzle holder are fastened together via the tip packing by fastening or tightening the retaining nut, a frictional force generated between a shoulder of the nozzle body and an inner seat surface of the retaining nut upon application of the axial fastening force induces twist of the nozzle body. The twist of the nozzle body, in turn, causes a reduction of a roundness of a sliding portion of a nozzle needle and can finally prevents smooth sliding movement of the nozzle needle.

Thus, the increase of the sealing surface pressure achieved by increasing the axial fastening force of the retaining nut poses various disadvantages in terms of deformation and strength of the components, such as the nozzle body. Furthermore, the arrangement that increases the sealing surface pressure of the components by increasing the axial fastening force of the retaining nut poses a disadvantage in terms of manufacturing costs.

SUMMARY OF THE INVENTION

Thus, it is an objective of the present invention to provide a sealing surface pressure increasing arrangement of a fluid conducting system capable of increasing a sealing surface pressure around a connection between fluid passages without substantially increasing an axial fastening force applied to the connection.

To achieve the objective of the present invention, there is provided a sealing surface pressure increasing arrangement of a fluid conducting system. The arrangement includes a first fluid conducting component, a second fluid conducting component and a third fluid conducting component. The first fluid conducting component has a first fluid passage therein. The second fluid conducting component has a second fluid passage therein. The third fluid conducting component is clamped between the first fluid conducting component and the second fluid conducting component and has a third fluid passage for communicating between the first fluid passage and the second fluid passage. At least one reduced thickness portion in a form of a recess is provided in at least one of a first contact surface between the first fluid conducting component and the third fluid conducting component and a second contact surface between the second fluid conducting component and the third fluid conducting component, so that a sealing surface area of the at least one of the first and second contact surfaces is reduced to increase a sealing surface pressure in the at least one of the first and second contact surfaces around at least one of the fluid passages.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
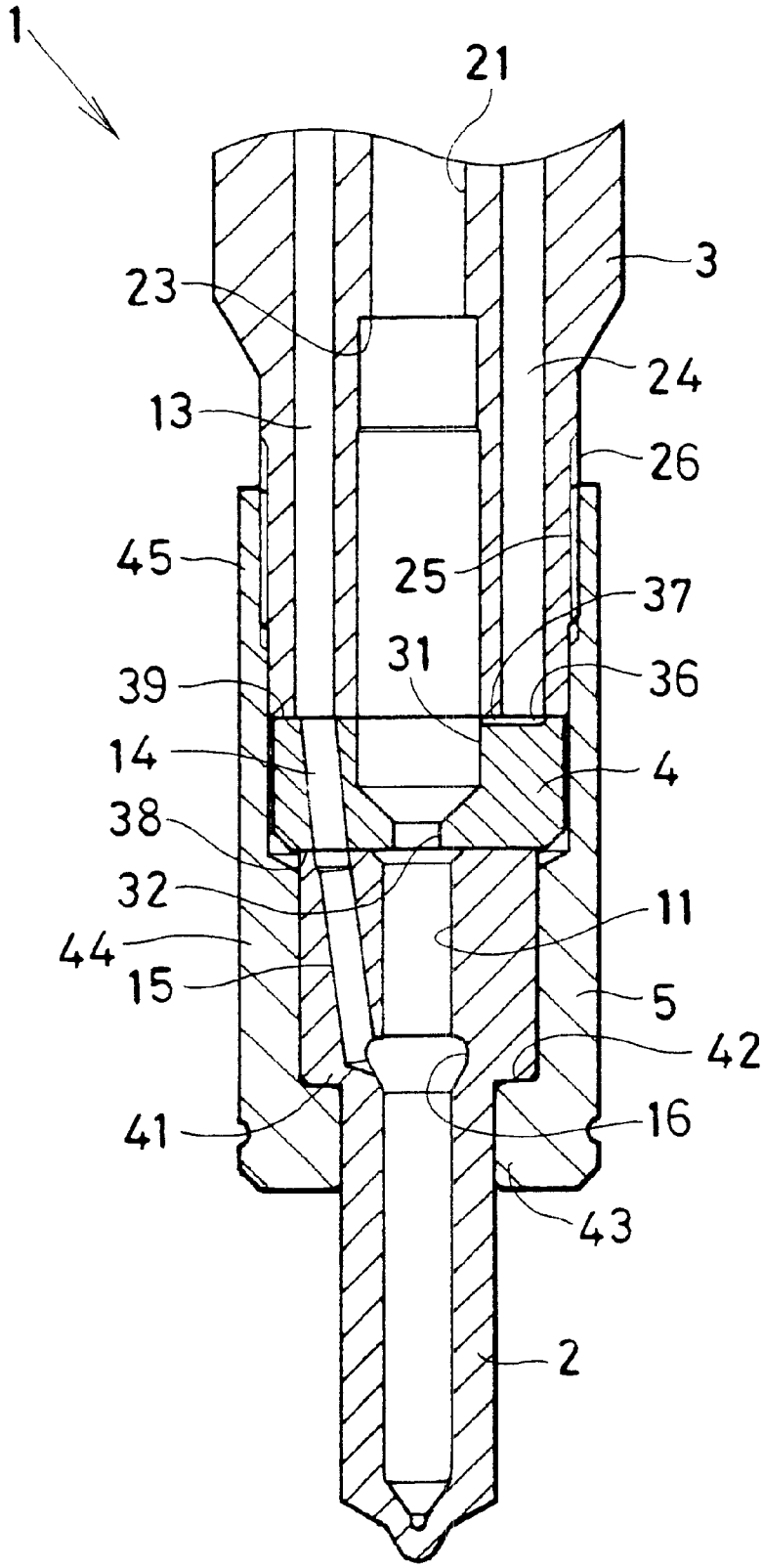
FIG. 1 is a cross-sectional view showing a main feature of a fuel injection nozzle of an internal combustion engine according to one embodiment of the present invention.

One embodiment of the present invention will be described with reference to FIGS. 1 to 2C.

A fuel injection nozzle 1 of an internal combustion engine according to the present embodiment is the fuel injection nozzle used in an injector of an accumulator fuel injection system (common rail system), which acts as a fluid conducting system. More particularly, the fuel injection nozzle is the direct-injection type fuel injection valve provided in each cylinder of a diesel engine (not shown). Highly pressurized fuel is pumped from a high-pressure supply pump (not shown) and is accumulated in a pressure accumulator chamber of a common rail of the fuel injection system. The highly pressurized fuel accumulated in the pressure accumulator chamber is directly injected into a corresponding combustion chamber through the fuel injection nozzle.

The fuel injection nozzle 1 includes a nozzle body 2, a nozzle holder 3, a tip packing 4 and a retaining nut 5. The nozzle body 2 receives a nozzle needle (not shown). The nozzle holder 3 receives an urging means, such as a spring, for urging the nozzle needle toward a valve closing side (downside in FIG. 1). The tip packing 4 is arranged between the nozzle body 2 and the nozzle holder 3. The retaining nut 5 connects or fastens the nozzle body 2 and the nozzle holder 3 together via the tip packing 4 with a predetermined axial fastening force.

Figure 2A:
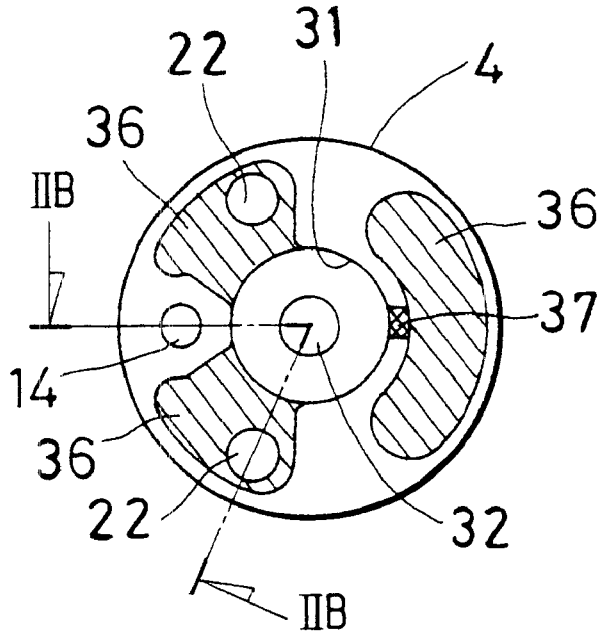
FIG. 2A is a top plan view of a tip packing of the fuel injection nozzle according to the embodiment, showing an upper end surface of the tip packing.
Figure 2B:
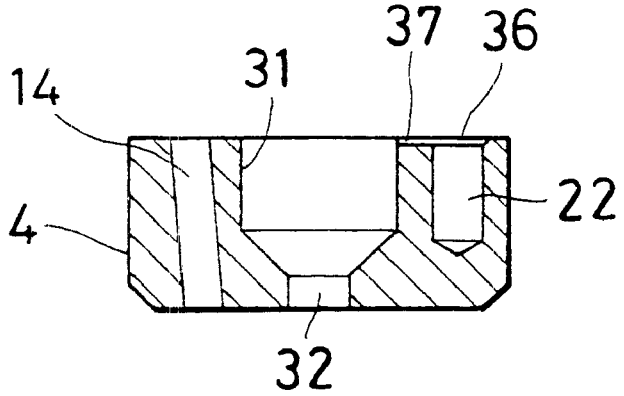
FIG. 2B is a cross-sectional view along line IIB—IIB in FIG. 2A.
Figure 2C:
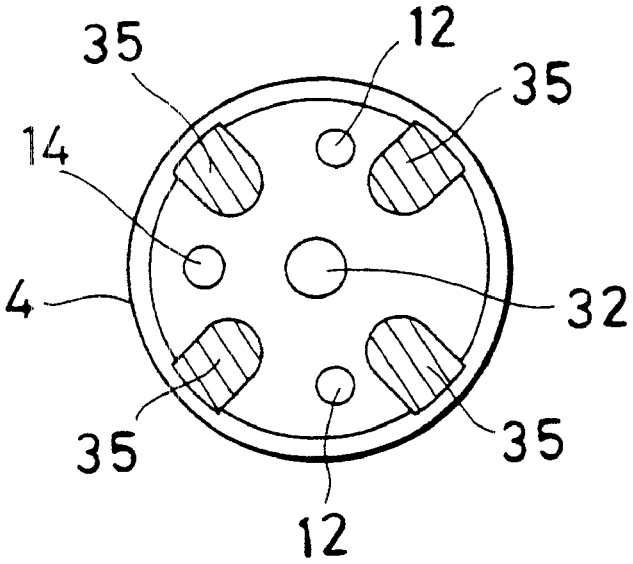
FIG. 2C is a bottom plan view of the tip packing according to the embodiment, showing a lower end surface of the tip packing.
Figure 3:
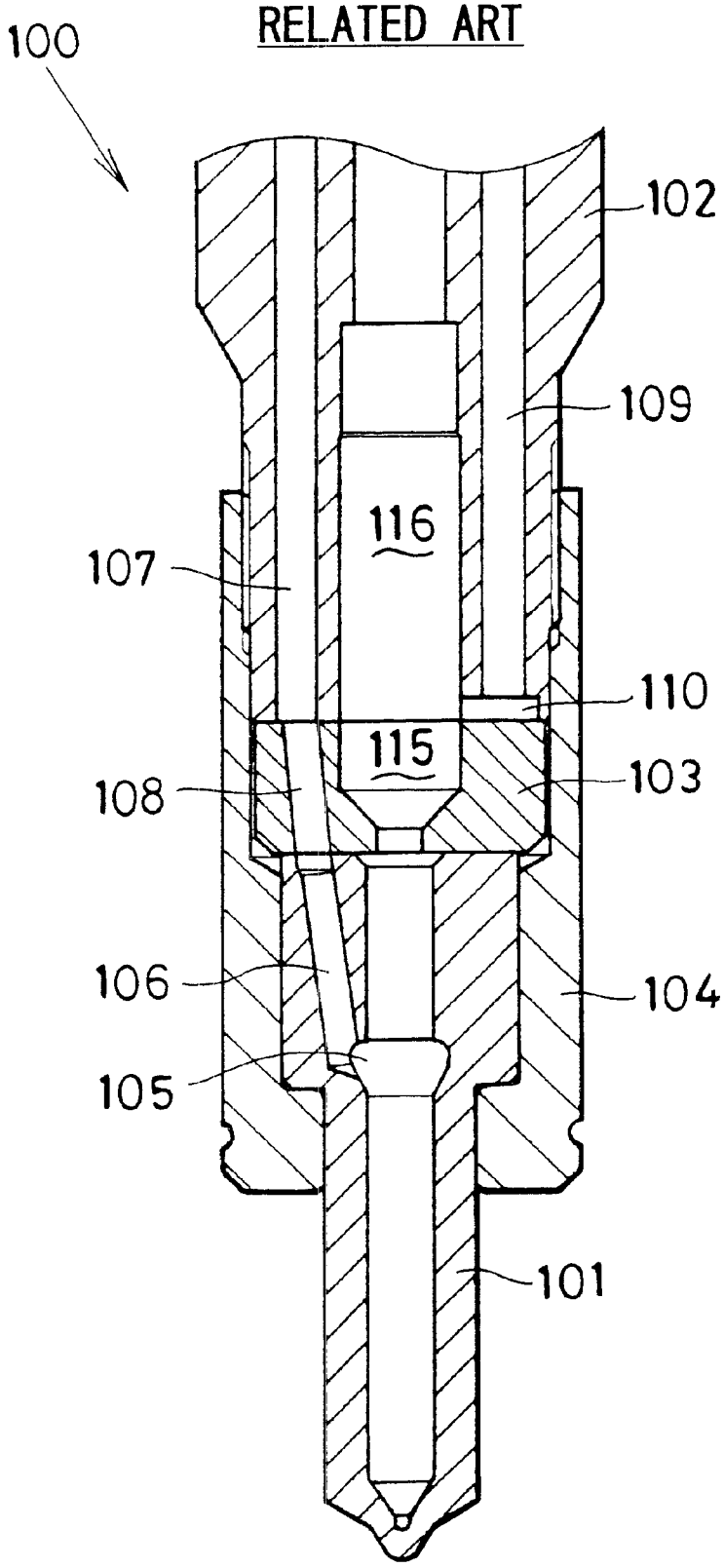
FIG. 3 RELATED ART
FIG. 3 is a cross-sectional view of a previously proposed fuel injection nozzle of an internal combustion engine.
Figure 4A:
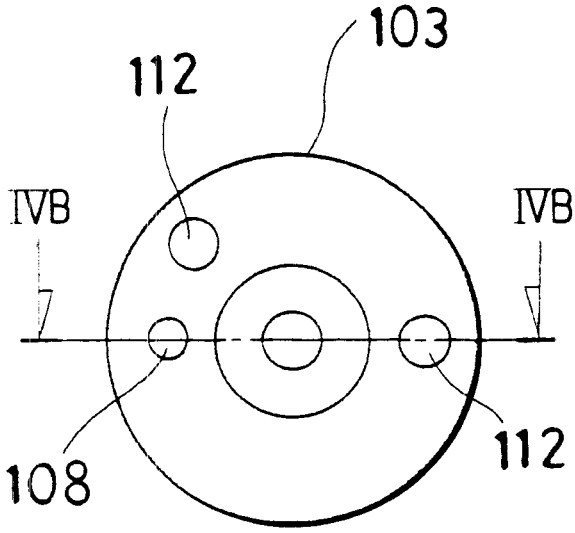
FIG. 4A RELATED ART
FIG. 4A is a top plan view of a tip packing of the previously proposed fuel injection nozzle, showing an upper end surface of the tip packing.
Figure 4B:
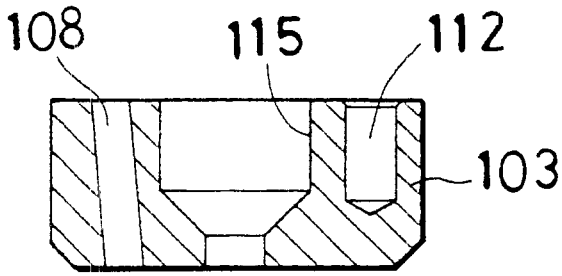
FIG. 4B RELATED ART
FIG. 4B is a cross-sectional view along line IVB—IVB in FIG. 4A.
Figure 4C:
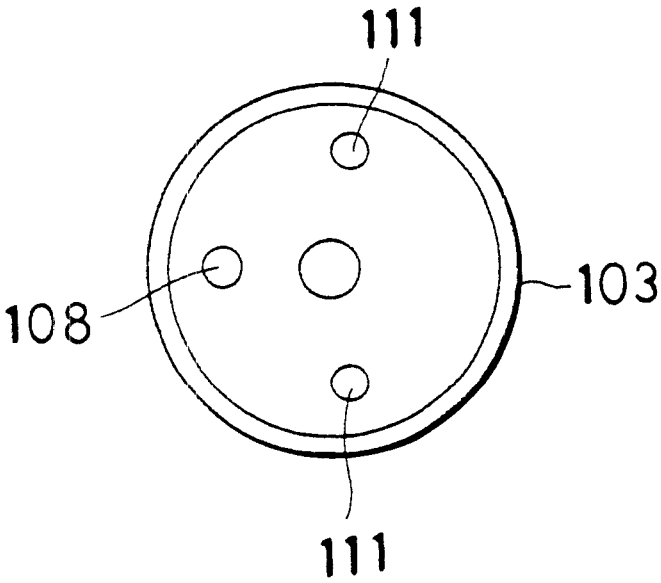
FIG. 4C RELATED ART
FIG. 4C is a bottom plan view of the tip packing of the previously proposed fuel injection nozzle, showing a lower end surface of the tip packing.

The nozzle body 2 corresponds to a first fluid conducting component of the present invention, which has one or more fuel injection holes at its distal end (lower end in FIG. 1). The highly pressurized fuel is injected from the nozzle body 2 through the one or more fuel injection holes. A slide bore 11 is formed in the nozzle body 2 for holding the nozzle needle in a slidable manner. A pressure chamber 16, which has an enlarged diameter, is provided in the middle of the slid bore 11. First pin holes (not shown) are formed in an upper end surface (i.e., a contact surface that contacts with the tip packing 4) of the nozzle body 2 in FIG. 1. Each first pin hole is communicated with a corresponding first pin hole 12 (described later) and receives a first knock-pin (not shown), which aids in positioning between the nozzle body 2 and the tip packing 4 during assembly and prevents relative rotation between the nozzle body 2 and the tip packing 4.

The nozzle body 2 further includes a fuel feed passage (corresponding to a first fluid passage of the present invention) 15 that extends from the contact surface in the upper end of the nozzle body 2 to the pressure chamber 16 in FIG. 1. The fuel feed passage 15 is communicated with a fuel supply passage 13 (described later) of the nozzle holder 3 and also with a fuel relay passage 14 (described later) of the tip packing 4 and thus constitutes a fuel passage for supplying the highly pressurized fuel from the pressure accumulator chamber of the common rail to the pressure chamber 16.

The nozzle holder 3 corresponds to a second fluid conducting component of the present invention. The nozzle holder 3 is a tubular body that includes a spring chamber 21 therein. The spring chamber 21 receives the urging means (not shown), such as the spring, and a pressure pin or hydraulic piston (not shown) connected to the nozzle needle. A lower part of the spring chamber 21, which is located below a step 23, has a larger diameter than an upper part of the spring chamber 21, which is located above the step 23 in FIG. 1.

A hydraulic pressure control chamber (not shown) is provided at one end (top side in FIG. 1) of the hydraulic piston. An electromagnetic actuator, such as an electromagnetic valve, supplies and drains hydraulic pressure or oil pressure relative to the hydraulic pressure control chamber. When the hydraulic pressure is drained from the hydraulic pressure control chamber, the nozzle needle and the hydraulic piston are urged against the urging force of the urging means, such as the spring, and thus are axially moved (lifted). That is, the nozzle needle is placed in a valve opening position. On the other hand, when the hydraulic pressure is supplied to the hydraulic pressure control chamber, the nozzle needle and the hydraulic piston are urged by the urging force of the urging means, such as the spring, and thus are axially moved to place the nozzle needle in a valve closing position.

Second pin holes (not shown) are formed in a lower end surface (i.e., a contact surface that contacts with the tip packing 4) of the nozzle holder 3 in FIG. 1. Each second pin hole is communicated with a second pin hole 22 (described later) of the tip packing 4 and receives a second knock-pin (not shown), which aids in positioning between the nozzle holder 3 and the tip packing 4 during assembly and prevents relative rotation between the nozzle holder 3 and the tip packing 4. Furthermore, the nozzle holder 3 has a joint portion (not shown). The joint portion of the nozzle holder 3 connects the nozzle holder 3 to a high-pressure pipeline, which, in turn, is connected to a branch pipe of the common rail. Thus, the highly pressurized fuel supplied from the common rail is provided to the joint portion of the nozzle holder 3.

The fuel supply passage (corresponding to a second fluid passage of the present invention) 13 is arranged in the joint portion of the nozzle holder 3 and also around the spring chamber 21. The fuel supply passage 13 supplies the highly pressurized fuel to the pressure chamber 16 of the nozzle body 2 via the fuel relay passage 14 of the tip packing 4 and the fuel feed passage 15 of the nozzle body 2. The nozzle holder 3 also has a fuel relief passage (leakage recovery passage) 24 for returning the fuel from the spring chamber 21 to a low-pressure pipeline system, such as a fuel tank. Furthermore, the nozzle holder 3 has a male threaded portion 26, which is formed around a lower end side of the nozzle holder 3 and is engaged with a female threaded portion 25 (described later) of the retaining nut 5.

The tip packing 4 corresponds to a third fluid conducting component of the present invention. The tip packing 4 is an annular body arranged between the contact surface in the upper end of the nozzle body 2 and the contact surface in the lower end of the nozzle holder 3 and has the fuel relay passage (corresponding to a third fluid passage of the present invention) 14, which communicates between the fuel feed passage 15 of the nozzle body 2 and the fuel supply passage 13 of the nozzle holder 3. A larger diameter bore 31 is formed in the tip packing 4. An inner diameter of the larger diameter bore 31 is larger than that of a smaller diameter bore 32 located below the larger diameter bore 31 in FIG. 1.

The center portion of a lower end surface of the tip packing 4 acts as a limiting surface. The limiting surface limits movement of the nozzle needle when an amount of movement (i.e., amount of lift) of the nozzle needle at the time of valve opening of the nozzle needle reaches its maximum amount. Furthermore, the tip packing 4 includes the first and second pin holes 12, 22 around the smaller diameter bore 32 and the larger diameter bore 31, respectively. Each first pin hole 12 is communicated with the corresponding first pin hole of the nozzle body 2 and receives the corresponding first knock-pin, which aids in positioning between the nozzle body 2 and the tip packing 4 during the assembly and prevents the relative rotation between the nozzle body 2 and the tip packing 4. Each second pin hole 22 is communicated with the corresponding second pin hole of the nozzle holder 3 and receives the corresponding second knock-pin, which aids in positioning between the nozzle holder 3 and the tip packing 4 during the assembly and prevents the relative rotation between the nozzle holder 3 and the tip packing 4.

A plurality of reduced thickness portions (shaded with oblique lines in FIG. 2) 35 in a form of a recess are provided in the lower end surface (i.e., the contact surface that contacts with the nozzle body 2) of the tip packing 4, which corresponds to a first contact surface of the present invention. The reduced thickness portions 35 act as first reduced thickness portions of the present invention and reduce a sealing surface area of the lower end surface of the tip packing 4 to reduce a sealing surface pressure around a connection between the corresponding fluid passages. The contact surface in the lower end of the tip packing 4 except the reduced thickness portions 35 substantially sealingly contacts with the contact surface (sealing surface) in the upper end of the nozzle body 2 to form a sealing surface 38 that provides a tight seal around a connection between the fuel feed passage 15 and the fuel relay passage 14.

A plurality of reduced thickness portions (shaded with oblique lines in FIG. 2) 36 in a form of a recess are provided in the upper end surface (i.e., the contact surface that contacts with the nozzle holder 3) of the tip packing 4, which corresponds to a second contact surface of the present invention. The reduced thickness portions 36 act as second reduced thickness portions of the present invention and reduce a sealing surface area of the upper end surface of the tip packing 4 to reduce a sealing surface pressure around a connection between the corresponding fluid passages. Another reduced thickness portion (indicated with a grid pattern in FIG. 2A) 37 in a form of a recess (acting as another second reduced thickness portion of the present invention) communicates between one of the reduced thickness portions 36 in the upper end surface of the tip packing 4 and the larger diameter bore 31. The reduced thickness portion 37 also acts as a leakage recovery passage. The leakage recovery passage returns the fuel, which has been conducted to the spring chamber 21, the larger diameter bore 31 and the smaller diameter bore 32, to the low-pressure pipeline system, such as the fuel tank. The contact surface in the upper end surface of the tip packing 4 except the reduced thickness portions 36, 37 substantially sealingly contacts with the contact surface (sealing surface) in the lower end of the nozzle holder 3 to form a sealing surface 39 that provides a tight seal around a connection between the fuel supply passage 13 and the fuel relay passage 14.

The retaining nut 5 corresponds to a fastening pipe member of the present invention. The retaining nut 5 applies a predetermined axial fastening force to achieve tight engagement between the contact surface in the upper end of the nozzle body 2 and the contact surface in the lower end of the nozzle holder 3 via the tip packing 4. The retaining nut 5 has an annular retaining portion 43 and a cylindrical sleeve portion 44. The retaining portion 43 has an inner seat surface 42 for receiving a shoulder 41 provided in the lower end surface of the nozzle body 2. The sleeve portion 44 extends upwardly in FIG. 1 from an outer peripheral edge of the retaining portion 43. An inner diameter of the sleeve portion 44 is larger than an inner diameter of a thinner-walled portion 45, which is arranged above the sleeve portion 44. The female threaded portion 25, which is threadably engaged with the male threaded portion 26 of the lower end side of the nozzle holder 3, is provided along an inner peripheral surface of the thinner-walled portion 45.

Operation of the fuel injection nozzle 1 of the present embodiment will be described with reference to FIGS. 1 to 2C.

The highly pressurized fuel is supplied from the common rail (high pressure source) to the pressure chamber 16 through the high-pressure pipeline, the fuel supply passage 13, the fuel relay passage 14 and the fuel feed passage 15. When the hydraulic pressure is drained from the hydraulic pressure control chamber arranged on the other end of the hydraulic piston, the pressure in the pressure chamber 16 becomes greater than the urging force of the urging means, such as the spring, so that the hydraulic piston and the nozzle needle are moved in the direction for opening the one or more fuel injection holes. Thus, the nozzle needle is lifted from the valve seat of the nozzle body 2, so that the highly pressurized fuel received in the pressure chamber 16 is injected into the corresponding combustion chamber of the diesel engine from the one or more injection holes arranged in the distal end of the nozzle body 2.

The fuel could leak from the fuel supply passage 13, the fuel relay passage 14, the fuel feed passage 15 and the pressure chamber 16 to a space between the nozzle needle and the spring chamber 21 of the nozzle holder 3, the larger diameter bore 31 of the tip packing 4 and the smaller diameter bore 32 of the tip packing 4. Then, the leaked fuel flows through the leakage recovery passage, which is formed between the contact surface in the lower end of the nozzle holder 3 and the reduced thickness portion 37 in the contact surface in the upper end of the tip packing 4. Thereafter, the leaked fuel flows through the fuel relief passage (leakage recovery passage) 24 in the nozzle holder 3 and is returned to the low-pressure pipeline system, such as the fuel tank.

Advantages of the above embodiment will now be described.

As described above, in the fuel injection nozzle 1 of the internal combustion engine of the present embodiment, the tip packing 4 is clamped between the contact surface (sealing surface) in the upper end of the nozzle body 2 and the contact surface (sealing surface) in the lower end of the nozzle holder 3 in FIG. 1. The reduced thickness portions 35 are formed by recessing corresponding portions of the contact surface in the lower end of the tip packing 4, and the reduced thickness portions 36 are formed by recessing corresponding portions of the contact surface in the upper end of the tip package 4. The reduced thickness portions 35, 36 are processed in such a manner that the reduced thickness portions 35, 36 do not interfere with the fuel relay passage 14, and thus do not cause leakage of the highly pressurized fuel from the fuel relay passage 14, and also the reduced thickness portions 35, 36 aid in achieving the high-pressure resistant seal, which can withstand the higher pressure that has been demanded in recent years.

Furthermore, similar to the reduced thickness portions 36, the reduced thickness portion 37 is formed by recessing the corresponding portion of the contact surface of the tip packing 4, which is tightly engaged with the contact surface (sealing surface) in the lower end of the nozzle holder 3. The reduced thickness portion 37 is formed to communicate with the fuel relief passage (leakage recovery passage) 24 of the nozzle holder 3. The reduced thickness portions 35–37 formed in the upper end surface and the lower end surface of the tip packing 4 allow a reduction of the corresponding sealing surface area without increasing the axial fastening force, which could pose disadvantages in terms of deformation of the component material and in terms of the component strength. The reduced thickness portions 35–37 are produced by a cutting operation.

Thus, the sealing surface pressure around the connection between the corresponding fluid passages is increased without substantially increasing the axial fastening force by reducing the sealing surface area. As a result, the increase in the sealing surface pressure around the connection between the corresponding fluid passages is possible to meet the recent demand for increasing the fuel injection pressure. Furthermore, it is not required to form the recess in a size that corresponds to that of the previously proposed leakage recovery passage 110. The reduced thickness portion 36 and the reduced thickness portion 37, which is communicated to the reduced thickness portion 36, cooperate together to form the leakage recovery passage. As a result, the structure of the contact surface of the nozzle holder 3 is simplified, allowing a reduction of the manufacturing cost.

According to the present embodiment, in the fuel injection nozzle 1 of the diesel engine that provides the higher fuel injection pressure, the high-pressure resistant seal is achieved at each sealing surface without requiring an increase in the axial fastening force of the retaining nut 5, which applies the predetermined axial fastening force to achieve tight engagement between the contact surface in the upper end of the nozzle body 2 and the contact surface in the lower end of the nozzle holder 3 via the tip packing 4.

Thus, in the tightening or fastening operation of the retaining nut 5 for applying the predetermined axial fastening force to achieve the tight engagement between the contact surface in the upper end of the nozzle body 2 and the contact surface in the lower end of the nozzle holder 3 via the tip packing 4, the nozzle body 2 is not substantially twisted by the frictional force generated between the shoulder 41 of the nozzle body 2 and the inner seat surface 42 of the retaining nut 5 upon application of the axial fastening force. As a result, it is possible to prevent the reduction of the roundness of the sliding portion of the nozzle needle, and thus the smooth sliding movement of the nozzle needle is allowed. Furthermore, the above arrangement is not only applicable to the accumulator fuel injection system but is also equally applicable to any device, which has a high-pressure sealing surface.

The above embodiment can be modified as follows.

In the above embodiment, the present invention is described with reference to the sealing surface pressure increasing arrangement of the fuel injection nozzle 1 used as the injector of the accumulator fuel injection system (common rail system), which has both the high-pressure supply pump and the common rail. However, the present invention is equally applicable to a sealing surface pressure increasing arrangement of a fuel injection nozzle of an injector used in a fuel injection system, which lifts a nozzle needle from a valve seat when a fuel pressure in a pressure chamber is increased beyond an urging force of an urging means, such as a spring, upon direct injection of highly pressurized fuel from an in-line fuel injection pump or from a distributor type fuel injection pump to the injector. Furthermore, the present invention is applicable to a variable nozzle, which can vary a size of a fuel injection hole.

Additional advantages and modifications will readily occur to those skilled in the art. The invention in its broader terms is therefore, not limited to the specific details, representative apparatus, and illustrative examples shown and described.

What is claimed is:

1. A sealing surface pressure increasing arrangement of a fluid conducting system, the arrangement comprising:

a first fluid conducting component, which has a first fluid passage therein;

a second fluid conducting component, which has a second fluid passage therein; and a third fluid conducting component, which is clamped between the first fluid conducting component and the second fluid conducting component and has a third fluid passage for communicating between the first fluid passage and the second fluid passage, wherein at least one reduced thickness portion in a form of a recess is provided in at least one of a first contact surface between the first fluid conducting component and the third fluid conducting component and a second contact surface between the second fluid conducting component and the third fluid conducting component, so that a sealing surface area of the at least one of the first and second contact surfaces is reduced to increase a sealing surface pressure in the at least one of the first and second contact surfaces around at least one of the first to third fluid passages.

2. A sealing surface pressure increasing arrangement according to claim 1, wherein at least one of the at least one reduced thickness portion is also used as a leakage recovery passage for recovering a fluid conducted from at least one of the first to third fluid passages.

3. A sealing surface pressure increasing arrangement according to claim 1, further comprising a fastening pipe member, which achieves tight contact of the first contact surface between the first fluid conducting component and the third fluid conducting component and also achieves tight contact of the second contact surface between the second fluid conducting component and the third fluid conducting component by exerting a predetermined axial fastening force to the first fluid conducting component, the third fluid conducting component and the second fluid conducting component to generate the sealing surface pressure.

4. A sealing surface pressure increasing arrangement according to claim 1, wherein the at least one reduced thickness portion is formed in the third fluid conducting component.

5. A sealing surface pressure increasing arrangement according to claim 1, wherein:

the at least one reduced thickness portion includes a plurality of first reduced thickness portions and a plurality of second reduced thickness portions;

the first reduced thickness portions are provided in the first contact surface between the first fluid conducting component and the third fluid conducting component; and the second reduced thickness portions are provided in the second contact surface between the second fluid conducting component and the third fluid conducting component.

6. A sealing surface pressure increasing arrangement according to claim 1, wherein:

the first fluid conducting component is a nozzle body, which slidably supports a nozzle needle therein, and the first fluid passage is a first fuel passage;

the second fluid conducting component is a nozzle holder, which receives an urging means for urging the nozzle needle toward a valve closing position, and the second fluid passage is a second fuel passage; and the third fluid conducting component is a tip packing, which limits an amount of lift of the nozzle needle at time of valve opening.

7. A sealing surface pressure increasing arrangement according to claim 6, wherein:

the nozzle holder has a fuel relief passage;

one end of the fuel relief passage is communicated with a low-pressure pipeline system; and the other end of the fuel relief passage is communicated with the at least one of the at least one reduced thickness portion, which is used as the leakage recovery passage.

8. A sealing surface pressure increasing arrangement according to claim 7, wherein:

the nozzle body includes a slide bore, which slidably supports the nozzle needle;

the nozzle holder includes a spring chamber, which receives the urging means;

the tip packing includes a larger diameter bore, which is communicated with the spring chamber of the nozzle holder, and a smaller diameter bore, which is communicated with the slide bore of the nozzle body; and the fuel relief passage is communicated with the larger diameter bore of the tip packing through the at least one of the at least one reduced thickness portion, which is used as the leakage recovery passage.

* * * * *